US006675716B1

(12) United States Patent
Nadler

(10) Patent No.: US 6,675,716 B1
(45) Date of Patent: Jan. 13, 2004

(54) PYROTECHNIC PELLET DECOY METHOD

(75) Inventor: Melvin P. Nadler, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1,826 days.

(21) Appl. No.: 06/186,887

(22) Filed: Aug. 25, 1980

(51) Int. Cl.[7] ..... F42B 4/26

(52) U.S. Cl. ..... 102/336; 102/505; 102/285; 149/2; 149/19.3; 149/114; 149/116; 89/1.11

(58) Field of Search ..... 102/336, 505, 102/513; 149/2, 19.3, 21, 87, 114, 115, 116; 343/18 E; 250/495; 89/1.11

(56) References Cited

U.S. PATENT DOCUMENTS

| | | | | | |
|---|---|---|---|---|---|
| 2,775,938 | A | * | 1/1957 | Wade | 102/336 |
| 3,765,334 | A | * | 10/1973 | Rentz et al. | 149/114 X |
| 4,060,435 | A | * | 11/1977 | Schroeder | 102/336 |
| 4,276,100 | A | * | 6/1981 | Colvin et al. | 149/19.3 |

* cited by examiner

*Primary Examiner*—Edward A. Miller
(74) *Attorney, Agent, or Firm*—David Kalmbaugh

(57) ABSTRACT

A method for decoying an infrared seeker comprising the steps of providing a plurality of small pyrotechnic pellets, igniting the pellets and dispersing the pellets.

1 Claim, No Drawings

PYROTECHNIC PELLET DECOY METHOD

BACKGROUND OF THE INVENTION

1. Field of the Invention

This invention relates to decoy flares. More particularly, this invention relates to infrared decoy flares.

2. Description of the Prior Art

Since the introduction of compositions based on the magnesium-fluorocarbon in 1959, infrared (IR) decoy flares have utilized this energy source. In the next 20 years, the use of seekers which can use two-color discrimination, area versus point source discrimination or other flare discriminators is anticipated. These seekers cannot be decoyed with the currently used magnesium-Teflon composition despite its intensity.

Many attempts have been made in the past two decades to increase the intensity of IR decoys and to modify the spectral distribution of the radiation they emit. These attempts have not met with significant success. The reports on these attempts make it evident that the work has been based on schemes to modify or increase the mass flow rate, the energy of the chemical reaction or the emitting species. While a large increase in radiance can be achieved either by a modest temperature increase or by a proportional increase in the radiating area, another largely ignored method for increasing the intensity depends on increasing the efficiency with which the flare flame is utilized as a source of radiant energy. One way in which this can be done is by insuring that the optical thickness of the flame is optimum.

Another largely neglected concept is that intensity may be increased by increasing the area of the pyrotechnic flame. One exception to this neglect is the "Roman Candle" concept of expelling flaming gouts of fuel. When this is done, effectively the radiating area is increased and, thus, the radiant energy presented to a seeker is also increased. However, this concept has only been partially successful. The implementation of it has inherent problems which have made its ultimate application to high-speed aircraft, especially in afterburner, of dubious utility.

SUMMARY OF THE INVENTION

This invention is based on what may conveniently be called a pyrotechnic pellet concept. The concept applies both of the aforementioned neglected concepts, i.e., increased radiating flare area and optimization of the optical thickness of the flare, and pyrotechnic pellets are no more restricted than conventional flares insofar as utilization by high-speed aircraft is concerned. Essentially, this invention involves the replacement of a large single grain of pyrotechnic material with a multiplicity of smaller pellets which will burn at different rates to allow tailoring of the intensity-time profile.

DESCRIPTION OF THE PREFERRED EMBODIMENTS

The pyrotechnic pellet concept of this invention represents a relatively new approach to optimum utilization of the chemical energy stored in the flare composition. Instead of attempting to increase the flame temperature, the radiating area is increased by utilizing many small flames in place of the conventional, single, large flame. The amount of increase that can be expected is difficult to compute; however, it should be approximately equal to the ratio between the total flame area of all the small pellets and that from the single large pellet. From observation of the flames produced by conventional flares, it may be estimated that the flame area is approximately 100 times the grain area. A quick analysis of the surface-to-volume ratio of a sphere allows one to see that replacing the original (assumed) spherical flame volume by the same volume in the form of smaller spheres will increase the area by the factor [r (large sphere)]÷[r (small sphere)]. Thus, if the analysis is only approximately correct, an increase in radiant intensity of the order of two to ten times should be a reasonable expectation. The optimum pellet size is that which produces the maximum area of flame which is opaque at the wavelengths of interest.

Some incidental benefits associated with the use of many small pellets in place of a single large one are the opportunity to control the intensity-time distribution by controlling the pellet composition and sizes; the control of spectral distribution through the use of different pellet compositions; the incorporation of RF chaff, either in the pellets and/or the interstices of the load. The load should accept dipoles of 0.5–1.0 cm in length which are appropriate for screening in X and K band.

In experiments leading to this invention, the loads of pyrotechnic pellets were designed to be fired from launchers that would also accept for firing any of the standard Navy IR decoy flares. The pyrotechnic composition of the pellets was selected from stock material.

Pellets experimented with were of four types. Type A pellets were cylindrical extruded pellets made from PL9000. They were about 0.5 cm in length, 0.432 cm in diameter and had cylindrical holes 0.157 cm in diameter running lengthwise through the center of them. Type B pellets were solid extruded cylinders made from N-35. They were about 0.5 cm long and 0.236 cm in diameter. Type C pellets had the same shape as type A pellets but were made from N-35. Type D pellets were also made from N-35. They were cylindrical in shape, 0.5 cm long, 0.356 cm in diameter with a hole running lengthwise through the center of them that was 0.036 cm in diameter. A small rectangular slit connected the hole to the pellet surface. This made the pellet look like a "C" or a "U". When burned in the laboratory, type A pellets burned for 0.15 second, type B. for 1.3, type C for 1.5 and type D for 0.9.

The burn time of the pellets was comparable to that of a single large magnesium-Teflon grain and only half the weight of pyrotechnic material was required to produce the aforementioned 30% increase in efficiency.

PL9000 is a designation for a composition fabricated from 13.5 wt. % Viton A, 13.5 wt. % Teflon #7, 10.0 wt. % graphite and 63 wt. % Mg gran. 16.

N-35 is a designation for a composition fabricated from 15.0 to 16.5 wt. percent of Viton A (the copolymer of vinylidene difluoride and hexafluoropropylene), 29.5 to 32.0 wt percent of Teflon #7 (polytetrafluoroethylene) and 52.5 to 54.5 wt. percent of gran. 15 magnesium.

Several pellet combinations and weight ratios were used during testing. Also, several ignition and dispersal methods that were compatible with standard Navy dispensers were tried. Some of the better combinations gave between 15 and 30% higher radiant efficiency in the 2–3 $\mu$m and 4–5 $\mu$m band than a standard Navy magnesium-Teflon decoy flare (MJU-8/B) with a comparable burn time and for only half the weight of pyrotechnic material.

At the present time, the best mode for practicing the invention that is known to the inventor involves using a combination containing 30 wt. percent type A pellets, 35 wt. percent type C and 35 wt. percent type D. This composition produced the nearly 30% higher radiant efficiency referred to above.

Many other combinations were experimented with successfully. Whatever composition-one uses in actual decoy operations will depend on the intensity desired and the burn time desired and further experimentation with yet untried shapes, sizes and compositions may prove to be even better than the combination specifically set forth above.

In practicing this invention, it is possible to coat the pellets with a boron/potassium nitrate mixture or the like to aid in ignition. The igniter tube of the launcher may also be coated with such a mixture for the same purpose.

While only four types of pellets were experimented with, and each type had a definite composition, size and shape, it will be apparent to those skilled in the art that other types with different compositions, sizes and shapes could be utilized. The essence of the invention lies in providing a plurality of small pellets to increase the intensity and in having the pellets burn for different lengths of time.

What is claimed is:

1. In a method for decoying an infrared seeker comprising the steps of providing a material which will produce infrared light when burned, igniting said material and deploying said material, the improvement residing in utilizing as said material a combination of 30 wt. percent of a first type of pellets, 35 wt. percent of a second type of pellets and 35 wt. percent of a third type of pellets wherein said first type of pellets are cylindrical extended pellets about 0.5 cm. long and 0.432 cm. in diameter that have cylindrical holes 0.157 cm. in diameter running lengthwise through the center of them and are fabricated from 13.5 wt. percent vinylidene difluoride and hexafluoropropylene coploymer, 13.5 wt. percent polytetrafluoroethylene, 10.0 wt. percent graphite and 63 wt. percent Mg, wherein said second type of pellets are of the same shape as first type and are fabricated from 15.0 to 16.5 wt. percent vinylidene difluoride and hexafluoropropylene copolymer, 29.5 to 32.0 wt. percent polytetrafluoroethylene and 52.5 and 59.5 wt. percent Mg and wherein said third type of pellets are fabricated from the same materials in the same amounts as said second type and have the same shape as said first and second types with the exception that said cylindrical hole is connected to their surface by means of a rectangular slit.

* * * * *